US006057076A

United States Patent [19]

Berkes et al.

[11] Patent Number: 6,057,076

[45] Date of Patent: May 2, 2000

[54] TONER COMPOSITION AND PROCESSES THEREOF

[75] Inventors: John S. Berkes, Webster; Eugene F. Young, Rochester; Raphael F. Bov, Jr., Pittsford, all of N.Y.

[73] Assignee: Xerox Corporation, Stamford, Conn.

[21] Appl. No.: 09/110,170

[22] Filed: Jul. 6, 1998

[51] Int. Cl.[7] ..... G03G 9/097

[52] U.S. Cl. ..... 430/137

[58] Field of Search ..... 430/137

[56] References Cited

U.S. PATENT DOCUMENTS

| | | | |
|---|---|---|---|
| 4,367,275 | 1/1983 | Aoki et al. | 430/99 |
| 4,971,882 | 11/1990 | Jugle | 430/110 |
| 5,080,986 | 1/1992 | Kmiecik-Lawrynowicz et al. | 430/39 |
| 5,153,091 | 10/1992 | Veregin et al. | 430/126 |
| 5,843,612 | 12/1998 | Lin et al. | 430/137 |

FOREIGN PATENT DOCUMENTS

| | | |
|---|---|---|
| 1442835 | 10/1973 | United Kingdom . |

*Primary Examiner*—Roland Martin
*Attorney, Agent, or Firm*—John L. Haack

[57] ABSTRACT

A process including:

mixing a resin, and a mixture of a first wax and a second wax; and grinding and classifying.

13 Claims, No Drawings

TONER COMPOSITION AND PROCESSES THEREOF

REFERENCE TO COPENDING APPLICATIONS AND ISSUED PATENTS

Attention is directed to commonly owned and assigned U.S. Pat. No. 4,859,550, issued Aug. 22, 1989, entitled "Smear Resistant Magnetic Image Character Recognition Processes", which patent discloses an electrophotographic process which comprises the generation of a latent image in an electronic printing MICR apparatus; thereafter developing the image with a toner composition comprised of resin particles, magnetite particles, and an aliphatic hydrocarbon, or an additive component comprised of polymeric alcohol of the formula $CH_3(CH_2)^nCH_2OH$ wherein n is a number of from about 30 to about 500; and subsequently providing the developed image with magnetic ink characters thereon to a reader/sorter device whereby toner offsetting and image smearing is minimized in said device.

Attention is also directed to commonly owned and assigned copending applications: U.S. Ser. No. 08/019,527 (D/97064), filed Jan. 5, 1998, entitled "TONER COMPOSITIONS", which application discloses a toner comprised of a mixture of first toner with wax, and second toner free of wax, and wherein the first and the second toner contain resin, and the first toner with wax contains colorant; and U.S. Ser. No. 08/058,997 (D/97510), filed Mar. 13, 1998, entitled "TONER COMPOSITION AND PROCESSES THEREOF", which application discloses a toner generated from a mixture of first toner with high molecular weight wax, and second toner with a low molecular weight wax, and wherein said first toner and said second toner contain resin, and colorant.

The disclosures of each the above mentioned patents and copending applications are incorporated herein by reference in their entirety. The appropriate components and processes of these patents may be selected for the toners and processes of the present invention in embodiments thereof.

BACKGROUND OF THE INVENTION

The present invention is generally directed to improved toner compositions and imaging processes thereof. More specifically, the present invention is directed to toners comprised of a resin, a colorant, and a mixture of two or more waxes, such as alkylene components, such as polyethylene wax and polypropylene wax, which are uniformly distributed in the bulk and on the surface of the toner particles, and wherein the surface of the toner is preferentially enriched in one wax, such as polyethylene wax, relative to the bulk wax content of the other wax, and to processes for the preparation thereof. The toners and development processes of the present invention, in embodiments, provide development donor rolls that are free, or substantially free of filming, fuser rolls free of, or substantially free of offset, an absence or minimization of deletions due to vinyl offset, image smear values, for example, at or below about 1.0, and more specifically from about 0.1 to about 1.0 in a reference scale, for example, after about 20 passes through high speed check processing equipment, such as the Xerox Corporation Model 9700 and no, or minimal degradation in MICR recognition rate during those 20 passes.

In other embodiments, the present invention is directed to imaging and printing processes with magnetic toner compositions, including magnetic, single component, and two component, developer compositions particularly useful for generating documents such as personal checks which are subsequently processed in reader/sorters. In one embodiment of the present invention there are provided processes for generating documents, such as checks, including for example dividend checks, turn around documents such as invoice statements like those submitted to customers by American Express and VISA, corporate checks, highway tickets, rebate checks, other documents with magnetic codes thereon, such as identification badges, and the like, with no, or minimal toner and image smearing.

The aforementioned and other advantages are achievable with the resin particle compositions and processes of the present invention. The toners and processes of the present invention are useful in many applications including printing, for example, electrophotographic, ionographic or magnetographic devices, such as in xerographic printers and copiers, especially MICR (magnetic ink character recognition) and related processes, including digital systems.

PRIOR ART

In U.S. Pat. No. 5,080,986, issued Jan. 14, 1992, there is disclosed an imaging process which comprises the generation of an image in an electronic printing magnetic image character recognition apparatus; and thereafter developing the image with an encapsulated toner composition comprised of a core with a fluorocarbon-incorporated polymer binder, magnetite, and optional color pigments and a polymeric shell.

In U.S. Pat. No. 4,367,275, issued Jan. 4 ,1983, there are disclosed methods of preventing offsetting of electrostatic images of the toner compositions to the fuser roll, which toner subsequently offsets to supporting substrates such as papers wherein there are selected toner compositions containing specific external lubricants including various waxes, see column 5, lines 32 to 45.

In U.S. Patent No. 5,153,091, issued Oct. 6, 1992, there is disclosed an ionographic process which comprises the generation of an image comprised of characters, and developing the image with a toner mixture comprised of an encapsulated toner and a toner free of encapsulation.

In U.K. Patent Publication 1,442,835, there are disclosed toner compositions containing resin particles, and polyalkylene compounds, such as polyethylene and polypropylene of a molecular weight of from about 1,500 to 6,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58.

The aforementioned patents are incorporated in their entirety by reference herein.

Many patents disclose the use of metal salts of fatty acids for incorporation into toner compositions, such as U.S. Pat. No. 3,655,374. Furthermore, references of background interest are U.S. Pat. Nos. 3,165,420; 3,236,776; 4,145,300; 4,271,249; 4,556,624; 4,557,991; and 4,604,338.

Although the above described toner and developer compositions are useful for their intended purposes, there is a need for improved compositions, preparative processes, and magnetic ink character recognition (MICR) processes thereof. More specifically, there is a need for processes enabling the generation of documents such as personal checks, with single and two component toner and developer compositions wherein toner offsetting and image smearing is avoided. There is also a need for the generation of developed images including the generation of personal checks in, for example, laser printers utilizing magnetic ink character recognition technology, wherein toner offset to protective foils present on the read and write heads is avoided, and image smearing is eliminated by adding to the toner, preferably as an internal additive, low molecular weight, less than about 20,000 weight average, such as a mixture of aliphatic hydrocarbons. In addition, there is a need for MICR processes for generating documents such as personal checks with toner and developer compositions that maintain their imaging characteristics for extended time periods exceeding, for example, 450,000 developed images. In addition, there is a need for MICR processes with toner and developer compositions wherein toner offsetting to protective foils, and image smearing on documents generated is reduced or eliminated. Furthermore, there is a need for processes wherein image smearing and offsetting is avoided by, for example, applying to the developed image by, for example, a hot roll applicator subsequent to, or during fusing a layer of additives including the mixed waxes illustrated herein. There is also a need for toners with improved fuser release agent function, that is, prevention of image offsetting to heated fuser rolls during the fusing process.

There remains a need for an economical, efficient, and environmentally acceptable method for the preparation of toners with, for example, superior flow, environmental stability, and charging properties, and imaging processes thereof.

SUMMARY OF THE INVENTION

Embodiments of the present invention, include:

A toner comprised of a resin, a colorant, and a mixture of polyethylene wax and polypropylene wax uniformly distributed in the toner bulk and on the surface of said toner particles, wherein the wax particles possess controlled particle or wax phase size, and wherein the surface of the toner is enriched in polyethylene wax relative to the bulk polyethylene wax content and the polypropylene wax content;

A process comprising mixing a resin, and a mixture of a first wax and a second wax; and grinding and classifying;

A process comprising melt mixing a resin, and a mixture of polyethylene wax and polypropylene wax using controlled shear during mastication which controls wax particle size or wax phase size;

A process comprising melt mixing a resin, and a mixture of polyethylene wax and polypropylene wax; and grinding and classifying the resulting melt mixed product, wherein there results a low smear magnetic image character recognition toner; and An electrophotographic process comprising: generating a latent image in an electronic printing MICR apparatus; developing the image with a toner composition comprised of resin particles, magnetite particles, and a mixture of polyethylene wax and polypropylene therein, and thereafter transferring and fusing the image; and subsequently providing the developed image with magnetic ink characters thereon to a reader/sorter device whereby toner offsetting and image smearing is minimized in the device.

DETAILED DESCRIPTION OF THE INVENTION

The present invention provides, in embodiments: processes with developer compositions and toner compositions that are useful for generating documents inclusive of personal checks, which documents are subsequently processed in reader/sorter devices as illustrated herein. More specifically, the present invention is directed to processes for generating documents, which comprise the formation of images, such as latent images with a printing device especially devices generating from about 8 to about 180 prints per minute; developing the image with a single, or two component developer composition (toner+carrier) as illustrated herein, which compositions contain, for example, resin particles, magnetite particles, and a mixture hydrocarbons, especially waxes as illustrated herein; subsequently transferring the developed image to a suitable substrate; permanently affixing the image thereto, and thereafter processing the documents in reader/sorters wherein image offsetting and image smearing are avoided or substantially reduced. Some examples of the aforementioned process wherein a toner with no hydrocarbon is selected is illustrated in U.S. Pat. No. 4,517,268, especially column 3, the disclosure of which is totally incorporated herein by reference. Examples of high speed electronic printing devices disclosed in the aforementioned patent, which devices can also be utilized for the process of the present invention, include the Xerox Corporation Model 8700™, and 9700™ MICR printer available from Xerox Corporation. More specifically, there can be selected for the generation of the documents with magnetic characters thereon the Xerox Corporation 9700™ MICR printer, about 120 prints per minute, the Xerox Corporation 8700™ MICR printer, about 72 prints per minute, and the like. Other examples of MICR machines using waxes for release and smear reduction include Xerox Corporation Models 4635 MX and 4197 MICR II printers. Also, there can be selected for the processes of the present invention other devices including ionographic printers such as the Delphax 4060™ printers, the Xerox Corporation 4040™, which contains a soft fuser roll for fixing purposes, the Xerox Corporation 4045™ and 4050™. Thereafter, the formed documents with magnetic characters thereon are processed in reader/sorter apparatuses as illustrated herein, and there results the advantages as indicated including low reject rates. In the present invention there are provided functional low smear MICR toners containing low concentrations of wax mixtures, such as polyethylene wax and polypropylene wax, using a low shear melt mix process, such as extrusion compared with high shear processes, such as Banbury/rubber mill. The present invention provides a means for controlling the polyethylene wax particle or wax phase dispersion such that the polyethylene particles or wax phase domains are from about 1 to about 4 micron in diameter. This relatively poor wax dispersion in extruded toners results in free wax particles during micronization. Consequently some wax will be lost during micronization and classification but the net result is that the toner surface will be enriched in polyethylene wax by either the preferential fracture through the wax domains during toner micronization and/or the toner surface is coated with wax by a free wax/toner collision mechanism during the micronization and classification process. This toner fabrication process produces a low smear MICR toner with, for example, only about 1.5 weight percent polyethylene and does not degrade the resin thereby enabling fuser release with only about 3 weight percent of polypropylene wax.

The present invention as illustrated herein provides a method of making MICR toner compositions with low polyethylene and polypropylene wax content, with substantially no donor roll filming, no fuser offset, with low vinyl offset properties, and no/low MICR smear was achieved with extruded toner with a relatively poor PE dispersion as illustrated herein.

The aforementioned developed images, especially personal checks with magnetic characters thereon, can then be utilized in a reader/sorter without offsetting and image smearing as indicated herein. The toner compositions selected for the process of the present invention are comprised of resin particles, magnetites, and optional colorant, such as pigment, dyes, and the like particles, such as carbon black and aliphatic hydrocarbons mixtures, such as polyethylene and polypropylene, and the like compounds.

As preferred magnetites selected for the toner compositions for the processes of the present invention, the magnetites as illustrated in U.S. Pat. No. 4,517,28, the disclosure of which is totally incorporated herein by reference, are utilized. Illustrative examples of aliphatic hydrocarbon waxes that may be selected as additives include low molecular weight polyethylene waxes with a weight average molecular weight of, for example, about 500 to about 3,000, for example available from Petrolite, Inc., and believed to contain no functional groups, reference also U.S. Pat. Nos. 4,557,991, 4,313,375, and 5,629,123, the disclosures of which are incorporated herein by reference in their entirety.

To prepare a low smear MICR toner of the present invention, there is added to the toner a polymeric lubricant such as polyethylene wax. The polyethylene wax is immiscible in the toner resin which property provides advantages and disadvantages. The polyethylene is preferably retained in the toner as a distinct phase for it to function properly and therefore the immiscibility is a positive attribute. For the toner to function properly it must be relatively homogeneous and consequently polyethylene blending becomes a problem. A high shear mixing method such as the Banbury/rubber mill process can be used to make these toners. However, the Banbury/rubber mill process if anything provides a dispersion which is too good for the polyethylene wax component and which toners then require that an excess of wax be added to achieve low smear. In addition, high shear will generally decrease the Tg and degrade the elastic component of the viscosity. For low melt resins this results in poor fuser release. For release agent managementless or free (RAMless) toners a solution to the fuser release problem was found by increasing the content of the internal release agent, such as, polypropylene wax. The consequence of trying to make a low smear MICR toner for single component development (SCD) applications by the Banbury/rubber mill process, is that the polyethylene wax concentration required for low smear is about 4 weight percent and the polypropylene wax concentration required for fuser release will be about 7 weight percent. These high wax content toners, for example, SCD toners and development systems, result in donor roll banding or filming and image defects on the resulting prints.

Accordingly, with the process utilizing the toner and developed compositions illustrated, the problems of image smearing to, and offsetting from the read and write heads in magnetic ink character recognition apparatuses is substantially eliminated, or is minimized. Moreover, in another embodiment the present invention is directed to improved economical processes for generating documents such as personal checks suitable for magnetic image character recognition wherein image smearing and toner offsetting, including offsetting to read and/or write heads including those with protective foils thereon, or unprotected heads as indicated herein is avoided when such documents are processed in reader/sorters.

Although not wanting to be limited by theory, it is believed that wax additive, such as the polyethylene or polypropylene waxes function as a agent against offset in the printing device and image smearing in the reader/sorter. By image smearing and offset in the reader/sorter is meant, for example, that the toner is released from the document, such as personal checks, and transfers and sticks to the aforementioned read and/or write heads. As a result, toner is removed from the checks, or other documents as illustrated herein primarily in a continuous manner causing image smearing, and substantially preventing the characters on the checks from being read magnetically and thus rejected in most instances. With the processes of the present invention, these problems are avoided, and more specifically, the reject rate is less than one half of 1 percent for 5,000 checks processed through, for example, in the aforesaid IBM 3890m reader/sorter 20 times, that is, a reject amount of about 25 checks per pass. Thus, with processes of the present invention, the reject rate is less than one half of 1 percent. It being noted that the acceptable reject rate usually does not exceed one half of 1 percent or about 0.5 percent. Typically, the reject rate with the process of the present invention is from about 0.05 to about 0.3 percent depending, for example, on the sorter set up conditions as contrasted to a reject rate in excess of one half of 1 percent, which is generally not acceptable, with processes utilizing toner and developer compositions that contain, for example, no polymeric wax or other additives therein. With toner build up on the read/write heads, the excess toner is released to the check document being processed causing image smearing, which is avoided with the processes of the present invention.

With further respect to the present invention, the process is particularly applicable to the generation of documents including personal checks, which have been fused with roll fusers. Fuser rolls such as TEFLON rolls or other nonconforming fuser rolls, reference for example, the hard fuser rolls incorporated into, for example, the Xerox Corporation 4197™ machine, are particularly useful with the processes of the present invention.

The documents, including the personal checks mentioned herein, can be obtained, for example, by generating a latent image thereon and subsequently developing the image, reference U.S. Pat. No. 4,517,268, the disclosure of which is totally incorporated herein by reference, with the toner and developer compositions illustrated herein. The developed image that has been created, for example, in the Xerox Corporation 9700™ MICR printer, reference the aforesaid '268 patent, contains thereon, for example, the characters zero, 1, 2, 3, 4, 5, 6, 7, 8, and 9, and up to five symbols (E-13B and CMC-7 font), which characters are magnetically readable by the IBM 3890™, or other similar apparatus. One of the problems avoided with the processes of the present invention is to eliminate or reduce the offsetting of the toner as indicated herein to the read and write heads in the apparatus selected for this purpose such as the IBM 3890™.

The present invention provides processes comprising:

melt mixing a resin, and a mixture of waxes, such as polyethylene wax and polypropylene wax; and grinding and classifying the resulting melt mixed product, wherein there results a low smear magnetic image character recognition toner.

The present invention provides an extruder-based melt mixing method wherein for example, the temperature of the extruder barrel is controlled at about 110 to about 130° C., and preferably about 115 to about 125° C., the screw speed is controlled at about 225 to about 250 RPM with feed rates of about 200 pounds per hour, and requiring about 17 kW total power. Internal friction raises the temperature of the mixture at the exit point to about 160° C.

In embodiments, the total weight wax of the toner is from about 1 to about 5 percent by weight, and can be comprised of, for example, a mixture of polyethylene wax and polypropylene wax in a relative weight ratio of from about 1:1 to about 1:5. The surface of the resulting product toner can be enriched in polyethylene wax content by from about 10 to about 50, and preferably from about 30 to about 50 weight percent with respect to the average polyethylene wax content in the bulk of the toner. The weight average molecular weight of the polyethylene wax additive can be, for example, from about 500 to about 3,000, and the weight average molecular weight of the polypropylene wax additive can be from about 1,000 to about 10,000.

Although not wanting to be limited by theory, it is believed that grinding and classifying of the melt mixed product results in free polyethylene wax particles. In embodiments, the free wax particles can become physically impacted on the surface of the resulting toner particles.

The particle size of the waxes in the resulting toner can be from about 1 to about 5 microns, for example, the polyethylene wax forms dispersed particle domains within the bulk resin, and wherein the dispersed polyethylene wax particle domains are from about 1 to about 4 microns in diameter.

In embodiments, the resulting toner has a measured low smear has value from about 0.1 to about 1.0, and a MICR recognition rate which is substantially the same for processing passes from 1 to about 20. Low smear is defined as a toner which when printed in the form of a check and processed for 20 passes on a device, such as, an IBM 3890, the smear is less than a value of 1.0 on an image smear scale and which processes possess the same or substantially the same recognition rate after about 20 passes as in the first pass.

Suitable toner resins include known toner binders, such as thermoplastics, and more specifically styrene-butadiene copolymers, styrene-acrylates, styrene-methacrylates, polyesters, and mixtures thereof. Toner particles in embodiments, can have a volume average diameter particle size of about 6 to about 25 and preferably from about 6 to about 14 microns. The toners can further include a second resin, a colorant or colorants, a charge additive, a flow additive, reuse or recycled toner fines. Also there can be blended at least one surface additive with the ground and classified melt mixed toner product.

The melt mixing can be accomplished in an extruder or a Banbury/rubber mill, and preferably in an extruder for superior results as illustrated herein, and wherein the grinding and classifying are accomplished in a fluid bed jet mill or a Sturtevant grinder. For example, the melt mixing can be accomplished in an extruder at a temperature of from about 300 to about 450° F., wherein following grinding and classification there results toner particles with a triboelectric charge of from about 5 to about 40 microcoulombs per gram, an admix of about 5 to about 15 seconds, a melt index of about 20 to 40 grams per 10 minutes, and a glass transition temperature of about 62 to about 66° C.

A process of the present invention comprises:

extruding in an extruder apparatus a mixture of polyethylene wax and polypropylene wax in an amount of about 1 to about 5 weight percent, a resin or resins in an amount of about 40 to about 80 weight percent, and a colorant, to provide a melt mixed product; containing a coarse dispersion of polyethylene wax particles with an average diameter of from about 1 to about 4 microns; and grinding and classifying the melt mixed product to provide toner particles of appropriate size.

There is also provided an electrophotographic process comprising:

generating a latent image in an electronic printing MICR apparatus;

developing the image with a toner composition prepared in accordance with the aforementioned preparative process, and comprised of resin particles, magnetite particles, and a mixture of polyethylene wax and polypropylene therein and thereafter transferring and fusing the resulting image on a receiver member; and subsequently providing the printed image with magnetic ink characters thereon to a reader/sorter device whereby toner offsetting and image smearing is minimized in the device. The present process can be employed with either or both single component (SCD) and two-component development systems. The reject rate in the reader/sorter device is less than about 0.25 to about 0.5 percent for from about 20 to about 25 passes in the reader/sorter device. The aforementioned process provides a development donor roll free of filming, a fuser roll free of offset, an absence of vinyl offset, and an image smear value below about 1.0 after about 20 passes through high speed reader/sorter check processing equipment.

Thus there is provided a toner comprised of a resin, a colorant, and polyethylene wax and polypropylene wax which waxes are uniformly distributed in the bulk and on the surface of said toner particles, and wherein the surface of the toner is enriched in polyethylene wax relative to the bulk polyethylene wax content and the bulk polypropylene content. In other embodiments of the present invention, polypropylene wax is not necessary for fusing systems when other release agents are present.

Low smear refers for example to a toner which when printed in the form of a check and processed for 20 passes on a device such as an IBM 3890 has a value of less than about 1.0 on an image smear scale and which processes possess the same recognition rate after about 20 passes as for the first pass. The weight ratio of the resin to the polyethylene and polypropylene wax mixture can be, for example, from about 100:1 to about 100:5, and the polyethylene and polypropylene wax mixture can be in a relative weight ratio of from about 1:1 to about 1:5. The weight average molecular weight of the polyethylene wax can be, for example, from about 500 to about 3,000, and preferably from about 1,000 to about 2,0000, and the weight average molecular weight of the polypropylene wax additive can be, for example, from about 1,000 to about 10,000, and preferably from about 3,000 to about 10,0000.

The surface of the resulting product toner is enriched in a component, such as the polyethylene wax content by from 30 to 50 percent with respect to the average polyethylene wax content in the bulk of the toner. Although not wanting to be limited by theory, it is believed that the enrichment of the toner particle surface in polyethylene wax content arises, for example, from preferential fracture through the wax domains during toner micronization and or the toner surface is coated with wax by free wax particles and toner particles colliding during the micronization and classification stages of the processing. X-ray Photoelectron Spectroscopy (XPS) indicated that toner prepared via low shear melt mix methods, such as the screw extruder, contains significantly more wax at the surface than toner prepared by high shear processes, using for example a Banbury rubber mill. A 40% decrease in the XPS signal response was noted for extruded toner relative to Banbury processed toner. This suggests a significant increase in wax content at the surface of the toner particles. Furthermore, testing in IBM 3890 MICR readers sorters showed that toners prepared by low shear processes had less image smear and offsetting to the reader sorter than the same toner formulation prepared by high shear processes.

The grinding and classifying of the melt mixed product can results in free polyethylene wax particles. It was noted that polyethylene levels varied during processing, that is from melt mix or extrusion to finished toner, but polypropylene levels were essentially constant throughout the process. In embodiments, the free wax particles can become physically impacted on the surface of the resulting toner particles during the grinding and classifying of the melt mixed product. The classified toner can have, for example, a volume average diameter particle size of about 1 to about 30 microns, and preferably of about 5 to about 14 microns, and wherein there results toner particles with a triboelectric charge of from about 5 to about 40 microcoulombs per gram, a glass transition temperature of about 62 to about 66° C., and a halving of the elastic viscosity. Higher shear in the Banbury/rubber mill process results in breaking down of the toner resin thereby reducing its viscosity by a factor of about two as revealed by a plot of elastic viscosity over the range of about $10^4$ to about $10^6$ versus temperature(° C.) relative to similar toners prepared using an extruder process. The Banbury/rubber mill toners frequently have a higher propensity for vinyl offset.

In aspects thereof, the present invention provides:

A process comprising:

extruding in an extruder apparatus a mixture of polyethylene wax and polypropylene wax in an amount of about 1 to about 5 weight percent, a resin or resins 20 in an amount of about 40 to about 80 weight percent, and a colorant, to provide a melt mixed product containing a coarse dispersion of polyethylene wax particles of about 1 to about 5 microns in average diameter, and wherein the toner has a glass transition temperature of about 60 to about 70° C., and preferably from about 62 to about 66° C.; and grinding and classifying the melt mixed product to provide toner particles; and An electrophotographic process comprising:

generating a latent image in an electronic printing MICR apparatus;

developing the image with a toner composition comprised of resin particles, magnetite particles, and a mixture of polyethylene wax and polypropylene therein; and subsequently providing the developed image with magnetic ink characters thereon to a reader/sorter device whereby toner offsetting and image smearing is minimized in the device. The developed MICR images are of high image quality and provide a reject rate in the reader/sorter device, for example, less than one half of one percent.

The toners and imaging processes of the present invention, in embodiments, provide development donor rolls that are substantially free of filming, fuser rolls that are free of offset, an absence, or minimization of vinyl offset, and an image smear value below about 1.0 after about 20 passes through high speed check processing equipment with no degradation in MICR recognition rate.

The present invention also provides a printing machine comprising a development system comprised of a developer comprised of the melt mixed toner product obtained from the process comprising: melt mixing a resin, and a mixture of polyethylene wax and polypropylene wax; and grinding and classifying the resulting melt mixed product, wherein there results a low smear magnetic image character recognition toner. In embodiments, the toner can be comprised of a resin, a colorant, and a mixture of polyethylene wax and polypropylene wax uniformly distributed in the bulk and on the surface of the toner particles, and wherein the surface of the toner is enriched in polyethylene wax relative to the bulk polyethylene wax content and the polypropylene content.

The present invention, in embodiments, encompasses developer compositions comprised of coated carrier particles comprising a core with a coating thereover comprised of at least one polymer, and a toner composition comprised of toner resin particles and a colorant, especially pigment particles.

Toner compositions can be prepared by a number of known methods, such as admixing and heating resin particles such as styrene butadiene copolymers, colorant particles such as magnetite, carbon black, or mixtures thereof, and preferably from about 0.5 percent to about 5 percent of charge enhancing additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 6 to about 12 microns, which diameters are determined by a Coulter Counter. Subsequently, the toner compositions can be classified utilizing, for example, a Donaldson Model B classifier for the purpose of removing toner fines, that is toner particles less than about 4 microns volume median diameter. Alternatively, the toner compositions are ground with a fluid bed grinder equipped with a classifier wheel and then classified.

Illustrative examples of resins suitable for toner and developer compositions of the present invention include linear or branched styrene acrylates, styrene methacrylates, styrene butadienes, vinyl resins, including linear or branched homopolymers and copolymers of two or more vinyl monomers; vinyl monomers include styrene, p-chlorostyrene, butadiene, isoprene, and myrcene; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; and the like. Preferred toner resins include styrene butadiene copolymers, mixtures thereof, and the like. Other preferred toner resins include styrene/n-butyl acrylate copolymers, PLIOLITES®; suspension polymerized styrene butadienes, reference U.S. Pat. No. 4,558,108, the disclosure of which is totally incorporated herein by reference.

In the toner compositions, the resin particles are present in a sufficient but effective amount, for example from about 70 to about 90 weight percent. Thus, when 1 percent by weight of the charge enhancing additive is present, and 10 percent by weight of pigment or colorant, such as carbon black, is contained therein, about 89 percent by weight of resin is selected. Also, the charge enhancing additive may be coated on the pigment particle. When used as a coating, the charge enhancing additive is present in an amount of from about 0.1 weight percent to about 5 weight percent, and preferably from about 0.3 weight percent to about 1 weight percent.

When the colorant particles are comprised of magnetites, thereby enabling single component toners in some instances if desired, which magnetites are a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

Colorant includes pigments, dyes, mixtures thereof, mixtures of pigments, mixtures of dyes, and the like.

There can also be blended with the toner compositions external additive particles including flow aid additives, which additives are usually present on the surface thereof. Examples of these additives include metal oxides, such as titanium oxides, strontium oxides, strontium titanantes, colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 10 percent by weight, and preferably in an amount of from about 0.1 percent by weight to about 5 percent by weight. Several of the aforementioned additives are illustrated in U.S. Pat. Nos. 3,590,000 and 3,800,588, the disclosures of which are totally incorporated herein by reference.

With further respect to the toners used in conjunction with the present invention, colloidal silicas, such as AEROSIL®, can be surface treated with the charge additives in an amount of from about 1 to about 30 weight percent and preferably 10 weight percent followed by the addition thereof to the toner in an amount of from 0.1 to 10 and preferably 0.1 to 1 weight percent.

Also, there are included in the toner compositions low molecular weight waxes, such as polypropylenes and polyethylenes commercially available from Allied Chemical and Petrolite Corporation, EPOLENE N-15® commercially available from Eastman Chemical Products, Inc., VISCOL 550-P®, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials of the present invention are optionally present in the toner composition or the polymer resin beads in various amounts, however, generally these waxes are present in the toner composition in an amount of from about 1 percent by weight to about 15 percent by weight, and preferably in an amount of from about 2 percent by weight to about 10 percent by weight and may in embodiments function as fuser roll release agents.

For the formulation of developer compositions, there are mixed with the toner particles carrier components, particularly those that are capable of triboelectrically assuming an opposite polarity to that of the toner composition. Accordingly, the carrier particles are selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference particles used the aforementioned coating composition, the coating generally containing terpolymers of styrene, methylmethacrylate, and a silane, such as triethoxy silane, reference U.S. Pat. Nos. 3,526,533, 4,937,166, and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000 microns, and in embodiments about 175 microns thereby permitting them to possess sufficient density and inertia to avoid adherence to the electrostatic images during the development process. The carrier component can be mixed with the toner composition in various suitable combinations, however, best results are obtained when about 1 to 5 parts per toner to about 10 parts to about 200 parts by weight of carrier are selected.

The toner composition used in conjunction with the coated carriers of the present invention can be prepared by a number of known methods as indicated herein including extrusion melt blending the toner resin particles, pigment particles, and a charge enhancing additive, followed by mechanical attrition. Other methods include those well known in the art such as spray drying, melt dispersion, emulsion aggregation, and extrusion processing. Also, as indicated herein the toner composition without the charge enhancing additive in the bulk toner can be prepared, followed by the addition of charge additive surface treated colloidal silicas.

The toner and developer compositions may be selected for use in electrostatographic imaging apparatuses containing therein conventional photoreceptors providing that they are capable of being charged positively or negatively. Thus, the toner and developer compositions can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

The toner compositions are usually jetted and classified subsequent to preparation to enable toner particles with a preferred average diameter of from about 5 to about 25 microns, more preferably from about 8 to about 12 microns, and most preferably from about 5 to about 8 microns. Also, the toner compositions preferably possess a triboelectric charge of from about 0.1 to about 2 femtocoulombs per micron as determined by the known charge spectrograph. Admix time for toners are preferably from about 5 seconds to 1 minute, and more specifically from about 5 to about 15 seconds as determined by the known charge spectrograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

Also, the toner compositions, in embodiments, of the present invention possess desirable narrow positive or negative charge distributions, optimal charging triboelectric values, preferably of from about 10 to about 40, and more preferably from about 10 to about 35 microcoulombs per gram as determined by the known Faraday Cage methods with from about 0.1 to about 5 weight percent in one embodiment of the charge enhancing additive; and rapid admix charging times as determined in the charge spectrograph of less than 15 seconds, and more preferably in some embodiments from about 1 to about 14 seconds.

The invention will further be illustrated in the following non limiting Examples, it being understood that the tabulated Examples are intended to be illustrative only and that the invention is not intended to be limited to the materials, conditions, process parameters, and the like, recited herein. Parts and percentages are by weight unless otherwise indicated.

EXAMPLE I

Extruded Toner Preparation. There was prepared in an extrusion device, available as Model ZSK-40 from Werner Pfleiderer, a toner composition by adding to the extrusion device a suitable toner resin, such as styrene-butadiene copolymers, styrene-acrylates, styrene-methacrylate, polyesters, and mixtures thereof, at approximately a 45 percent by weight, a suitable pigment, comprised of magnetite, including a mixture of iron oxides ($FeO.Fe_2O_3$) such as those commercially available as Toda MTH009F (hexahedron), EPT1000 (octahedron), Magnox TMB100 (cubic), Toda MAT222 (granular), Magnox B251, B254, and B353 (all three acicular), or MAT5212L octahedral), present in the toner composition in an amount of approximately 50 percent by weight and a suitable combination of waxes such that the total weight of wax is about 5 percent by weight, and such wax is comprised of a mixture of polyethylene wax and polypropylene wax in a relative weight ratio of from about 1:1 to about 1:5, and preferably from about 1:2 to about 1:4, and more preferably about 1:3. The temperature of the barrels was controlled at about 120° C., screw speed was controlled at about 250 RPM and feed rates were about 200 pounds per hour, requiring about 17 kW total power. Internal friction typically raised the temperature of the mixture at the exit point to about 160° C. The melt product exiting from the extruder was cooled to about 25° C. on a belt and then crushed into small particles. The resulting toner was subjected to grinding on an AFG micronizer, Model 200AFG, providing toner particles with a volume median diameter of about 9 to about 13 microns as measured by a Coulter counter. Thereafter, the aforementioned toner particles were classified in a Donaldson Model B classifier to remove fine particles with a volume median diameter of less than about, or equal to about four microns. The final volume median diameter of the toner after classification was about 9.48 microns. The physical properties and performance characteristics of the resulting extruded toner was measured and tabulated in Table 1.

COMPARATIVE EXAMPLE I

Banbury Toner Preparation. Example I was repeated with the exception that the toner was melt mixed in a Farrel laboratory scale Banbury mixer with similar proportions of resin, pigment and wax. Melt mixing occurred through internal heating due to mechanical shear at a rotor speed of about 77 rpm with cooling on. Ram pressure was about 20 psi, down time was about 3 minutes and ram up time of about 2 minutes, resulting in temperatures of about 190° F. to about 200° F. This was followed by circulation on a rubber mill at a 0.100" gap and roll speeds of 30 feet per minute front and 40 feet per minute rear for about 5 minutes with cooling on. Subsequent processing did not differ substantially from the aforementioned Example I toner. The final volume median diameter of the toner after classification was about 9.48 microns. The physical properties and performance characteristics of the resulting Banbury/Rubber Mill toner was measured and tabulated in Table 1.

Table 1 compares toner-wax properties obtained with alternative toner processing methods. The toner-wax dispersion and performance characteristics for toners prepared by Banbury/Rubber Mill (B/R) which has higher shear, and an Extruder (EX) which has lower shear, indicate that the extrusion method, for example, in an extruder, provides preferred beneficial results and without detrimental results.

TABLE 1

Comparison of Preparation Method - Extruded toners versus Banbury/Rubber Mill toners.

| Property | Banbury/Rubber Mill (B/R) | Extrusion(EX) | Analytical Method |
|---|---|---|---|
| Wax Dispersion | Very Good | Good | TEM |
| PE130 Wax Domain Size | <1 μm | 1–4 microns | TEM |
| Toner Shape | Rounded | Angular | SEM |
| Surface Wax Concentration | ≈Formulation | >>Formulation[2] | XPS |
| PE130 Wax Loss During Fabrication | 0–5 wt. % | ≈25 weight % | DSC |
| % PE130 Wax For Low Smear | 4 wt. %[1] | 1.5–2 wt.%[2] | Smear Test |
| % P200 Wax For Fuser Release | 7 wt. %[1] | 3 wt. %[2] | Fuser Test |
| Resin Modification | Yes[1] | No[2] | DSC, Viscoelasticity |
| Vinyl Offset | >E500[1] | =E500[2] | Vinyl Test |
| Agglomerate Level | | <E500 at 35K[2] | Screening |
| Donor Roll Filming | | ≈None at 35K[2] | Microscopy |

[1] indicates comparative detrimental effects
[2] indicates comparative advantageous effects.
[3] E500 is a non-MICR toner designed to work in the same xerographic system.

Table 2 compares the functional behavior of extruded (EX) toners, samples 1 and 3, with Banbury/Rubber Mill (B/R) prepared toners, samples 2 and 4, at 2 and 4% initial polyethylene wax concentrations, respectively. The polypropylene content was constant at about 3.0 percent by weight in samples 1–4. A "Yes" in the last three columns of the Table indicates a detrimental effect of the processing on the toner properties. Each of the extruded (EX) samples exhibited better performance than the Banbury/Rubber Mill (B/R) prepared samples irrespective of wax content.

TABLE 2

Comparison of extrusion prepared toners with Banbury/Rubber Mill prepared toners.

| Sample | Fabrication Method | Tg(° C.) | % PE130 Formulated | % PE130 Actual | Donor Roll Banding | Fuser Roll Offset | MICR smear |
|---|---|---|---|---|---|---|---|
| 1 | B/R | 64.7 | 2.0 | 1.9 | — | — | Yes |
| 2 | EX | 66.0 | 2.0 | 1.5 | No | No | No |
| 3 | B/R | 63.1 | 4.0 | 3.9 | Yes | Yes | No |
| 4 | EX | 64.1 | 4.0 | 3.0 | Yes | No | No |

To further assess the relative efficacy of the Banbury and Extrusion toner preparative methods there was plotted the percent polyethylene added to the toner as formulated versus the percent polyethylene in the toner after processing as measured by differential scanning calorimetry (DSC). The plotted data consistently indicated that the relatively poor wax dispersions in extruded toners results in greater loss of wax during micronization and classification compared to the Banbury prepared toners.

Although not wanting to be limited by theory it is believed that these results suggest that the extruded toner surface is enriched in polyethylene wax by either the preferential fracture through the wax domains during toner micronization and/or the toner surface is coated with wax by a free wax or toner collision mechanism during the micronization and classification process.

Transmission electron microscopy (TEM) photomicrographs of the prepared toners indicated that the wax dispersions obtained by the extrusion method are superior to the toners prepared by the Banbury rubber mill method. Since wax particles are typically more brittle than the resin, fracturing of the toner particles during micronization occurs preferentially through the large wax particles resulting in higher wax concentrations at the toner surface of the extruded toner samples. Hence the toners made by the extrusion process with comparatively poor wax dispersions result in toners with an elevated or disproportionately higher surface wax concentration, and which elevated surface wax concentration is highly desirable for superior performing low smear MICR toner applications.

Other modifications of the present invention may occur to one of ordinary skill in the art based upon a review of the present application and these modifications, including equivalents thereof, are intended to be included within the scope of the present invention.

What is claimed is:

1. A process comprising:

mixing a resin, and a mixture of a first wax and a second wax; and grinding and classifying to form particles, wherein the mixing is accomplished in an extruder at a temperature of from about 250 to about 350° F., wherein the first wax is a polyethylene and the second wax is a polypropylene in a weight ratio of from about 1:1 to about 1:5 with a total wax content of from about 1 to about 7 percent by weight, and wherein the surface of the particles is enriched in polyethylene content by from about 30 to about 50 weight percent compared to the average polyethylene content in the particle bulk.

2. A process in accordance with claim 1, wherein there results a MICR toner and which toner possesses low smear of from about 0.1 to about 1.0, and a MICR recognition rate which is substantially the same for processing passes 1 to about 20.

3. A process in accordance with claim 1, wherein the weight average molecular weight of said polyethylene wax is from about 500 to about 3,000 and the weight average molecular weight of said polypropylene wax is from about 1,000 to about 10,000.

4. A process in accordance with claim 1, wherein grinding and classifying of the mixed product results in free polyethylene wax particles in the resulting toner.

5. A process in accordance with claim 1, wherein the waxes are particles and are physically impacted on the surface of the resulting toner particles.

6. A process in accordance with claim 1, wherein the resin is a styrene-butadiene copolymer, a styrene-acrylate, a styrene-methacrylate, a polyester, or mixtures thereof, and wherein the resulting toner has a volume average diameter particle size of about 6 to about 14 microns.

7. A process in accordance with claim 1, wherein the polyethylene wax forms dispersed particle domains within the bulk resin, and wherein the dispersed polyethylene wax particle domains are from about 1 to about 5 microns in volume average diameter.

8. A process in accordance with claim 1, wherein grinding the toner results in fracture through the large wax domains and wherein the surface of the resulting toner particles has an enriched wax concentration relative to the bulk wax concentration.

9. A process in accordance with claim 1, wherein the mixing is accomplished in a melt in an extruder and wherein the grinding and classifying are accomplished in a fluid bed jet mill or a Sturtevant grinder.

10. A process in accordance with claim 1, wherein there results toner particles with a triboelectric charge of from about 5 to about 40 microcoulombs per gram, an admix of about 5 to about 15 seconds, and a glass transition temperature of about 62 to about 66° C.

11. A process in accordance with claim 1, further comprising a second resin, a colorant, a charge additive, a flow additive, and reuse or recycled toner fines.

12. A process in accordance with claim 1, further comprising blending at least one surface additive with the ground and classified product.

13. A process comprising:

generating in an extruder apparatus a mixture of polyethylene wax and polypropylene wax in an amount of about 1 to about 5 weight percent, a resin or resins in an amount of about 40 to about 80 weight percent, and a colorant, to provide a melt mixed product; and grinding and classifying the melt mixed product to provide toner particles, wherein the surface of the resulting product toner particles is enriched in polyethylene wax content compared to the average polyethylene wax content in the bulk of the toner, and wherein the toner possesses low smear of from about 0.1 to about 1.0, and a MICR recognition rate which is substantially the same for processing passes 1 to about 20.

* * * * *